US006856085B2

(12) United States Patent
Yonezawa et al.

(10) Patent No.: US 6,856,085 B2
(45) Date of Patent: Feb. 15, 2005

(54) FLUORESCENT LUMINOUS TUBE HAVING SPECIFIC SUPPORT STRUCTURE FOR WIRE SHAPED MEMBER

(75) Inventors: Yoshihisa Yonezawa, Chiba (JP); Yukio Ogawa, Chiba (JP); Hiroaki Kawasaki, Chiba (JP)

(73) Assignee: Futuba Corporation, Chiba (JP)

( * ) Notice: Subject to any disclaimer, the term of this patent is extended or adjusted under 35 U.S.C. 154(b) by 189 days.

(21) Appl. No.: 10/307,953

(22) Filed: Dec. 3, 2002

(65) Prior Publication Data

US 2003/0102799 A1 Jun. 5, 2003

(30) Foreign Application Priority Data

Dec. 3, 2001 (JP) ..... 2001-369151

(51) Int. Cl.[7] ..... H01J 1/62; H01J 1/88

(52) U.S. Cl. ..... 313/495; 313/272; 313/271; 313/496; 313/497

(58) Field of Search ..... 313/495–496, 313/456, 422, 277, 272, 278

(56) References Cited

U.S. PATENT DOCUMENTS 4,788,472 A * 11/1988 Katakami ..... 313/496
4,982,134 A * 1/1991 Aono et al. ..... 313/456
6,717,350 B2 * 4/2004 Yonezawa et al. ..... 313/495

* cited by examiner

*Primary Examiner*—Joseph Williams
*Assistant Examiner*—Anthony Perry
(74) *Attorney, Agent, or Firm*—Bacon & Thomas

(57) ABSTRACT

A fluorescent luminous tube includes a vacuumed envelope having two base members, an anode and a cathode installed inside the vacuumed envelope, a first and a second metal layer formed on one of the two base members, a wire shaped member mounted inside the vacuumed envelope, and a first and a second spacer, made of a metal, for supporting the wire shaped member at a predetermined height. One end portion of the wire shaped member is wound around the first spacer to be supported at the predetermined height and is interposed between the first spacer and the first metal layer to be fixed thereto. Further, the other end portion of the wire shaped member is supported at the predetermined height by the second spacer and is fixed to the second metal.

7 Claims, 16 Drawing Sheets

FLUORESCENT LUMINOUS TUBE HAVING SPECIFIC SUPPORT STRUCTURE FOR WIRE SHAPED MEMBER

FIELD OF THE INVENTION

The present invention relates to a fluorescent luminous tube; and, more particularly, to a fixing member (supporting member) of a linear member such as a cathode filament in a fluorescent luminous tube.

BACKGROUND OF THE INVENTION

Referring to FIGS. 1A to 2C, a conventional fluorescent luminous tube, for example, a conventional fluorescent display tube, will be described. Like reference numerals in FIGS. 1A to 2C represent like parts.

FIGS. 1A to 1C show various views of a prior art fluorescent display tube, wherein FIG. 1A is a top view thereof; FIG. 1B is a partial cross sectional perspective view of an anchor thereof; and FIG. 1C is a partial cross sectional perspective view of a support thereof.

As shown in FIG. 1A, the prior art fluorescent display tube includes a substrate 30 made of an insulation material such as a glass or a ceramic, cathode filaments F, cathode electrodes 31 and 32, cathode wirings 311 and 321, an anchor 33 and a support 34 of the filaments F. The anchor 33 has a mounting portion 331, resilient portions 332, filament-mounting portions 333 and upper pieces 334 (FIG. 1B). The support 34 has a mounting portion 341, filament-mounting portions 342 and upper pieces 343 (FIG. 1C).

The cathode electrodes 31 and 32 are made of metallic layers or plates formed of aluminum, for example, and are fixed on the substrate 30, e.g., by an adhesive agent of a fritted glass, and so forth. The mounting portions 331 and 341 of the anchor 33 and the support 34 are fixedly adhered to the cathode electrodes 31 and 32 by welding, respectively. One end portion of each filament F is interposed between a filament-mounting portion 333 of the anchor 33 and an upper piece 334 welded thereon. Similarly, the other end portion of each filament F is fixedly mounted between a filament-mounting portion 342 of the support 34 and an upper piece 343, fixedly welded thereon. Each resilient portion 332 of the anchor 33 exerts a tensile force on a corresponding filament F.

In such fluorescent display tube, the anchor 33 and the support 34 are formed by press working, thereby increasing the manufacturing costs thereof. Further, since they have three-dimensional shapes with a predetermined strength, reduction of their sizes is limited, which in turn restricts the scaling-down or the reduction in the thickness of the fluorescent display tube. Additionally, the fluorescent display tube in FIGS. 1A to 1C requires a complicated mounting process; i.e., mounting the anchor 33 and the support 34 on the cathode electrodes 31 and 32, respectively, and then mounting the filaments F on the anchor 33 and the support 34. Moreover, since the mounting process is carried out by heating welding such as resistance welding, the cathode electrodes 31 and 32 may be damaged in the course of the welding process if they are thin, and in certain cases, a crack may be developed in the substrate 30 due to the difference in the thermal expansion coefficients of the substrate 30 and the cathode electrodes 31 and 32.

Referring to FIGS. 2A and 2B, there are illustrated a plan view and a cross sectional view of another prior art fluorescent display tube, respectively, wherein FIG. 2B is the cross sectional view taken along the line Y—Y in FIG. 2A. FIG. 2C illustrates a temperature profile of a filament.

As shown, reference numerals 351, 352 represent metallic pieces, made of, e.g., aluminum, for welding filaments F to cathode electrodes 31 and 32, respectively; and 361, 362 represent spacers, made of an insulating material, such as a glass, or a metal, for sustaining the filaments F at a predetermined vertical position. Each filament F has a linear portion F1, coiled portions F2 and F3, and end portions F4 and F5.

One end portion F4 of each filament F is interposed between the cathode electrode 31 and a metallic piece 351 welded thereon. Similarly, the other end portion F5 of each filament F is fixedly mounted between the cathode electrode 32 and a metallic piece 352 fixedly welded thereon. Coiled portions F2 and F3 of each filament F exert a tensile force on a corresponding filament F.

The florescent display tube in FIGS. 2A and 2B does not require an anchor and a support, but necessitates the spacers 361 and 362. Further, spaces are needed for accommodating the metallic pieces 351 and 352, the spacers 361 and 362, the coiled portions F2 and F3 thereto. These spaces are the so-called "dead spaces" which cannot be used in displaying an image. Additionally, the coiled portions F2 and F3 of the filaments F waste power without contributing to the display. Also, as in the case of the fluorescent display tube of FIGS. 1A and 1B, when the end portions F4 and F5 of the filaments F are heating-welded, the cathode electrodes 31 and 32 may be damaged by heat or a crack may be developed in the substrate 30, if the cathode electrodes 31 and 32 are thin.

Referring to FIG. 2C, there is illustrated a temperature profile of a filament F. The horizontal axis represents a lengthwise position in the filament F and the vertical axis represents a temperature of the filament F. The heat generated by the filament F is dissipated by the spacers 361 and 362, lowering the temperature in sections P1–P2 of the filament F. The sections P1–P2 are "end cool zones", where emission of thermal electrons is absent or insufficient due to the low temperature, and therefore do not contribute to the display. The filament zone contributing to the display is a section P2—P2. The filament F has a core wire, made of tungsten, a rhenium and tungsten alloy or the like, coated with a material, such as ternary carbonate, for emitting thermal electrons. The filament F is driven such that the temperature in the section P2—P2 is maintained at 600–650° C.

The length of each of the sections P1–P2 varies depending on the thickness of the filament F and is, for example, about 10 mm if the core wire is 15 $\mu$m in diameter.

SUMMARY OF THE INVENTION

It is, therefore, a primary object of the present invention to provide a fluorescent luminous tube, wherein a filament is supported in a cost effective way without using costly fixing parts, thereby facilitating a filament mounting process without incurring a damage in a cathode electrode and a crack in a substrate due to heating-welding.

Another object of the present invention is to provide a fluorescent luminous tube in which a dead space and end cool zones can be minimized to enable a further scaling down of the fluorescent luminous tube in terms of size, thickness and power consumption.

In accordance with a preferred embodiment of the present invention, there is a fluorescent luminous tube, which includes a vacuumed envelope having two base members, an anode installed inside the vacuumed envelope, and a cathode arranged inside the vacuumed envelope, the fluorescent luminous tube including: a first and a second metal layers formed on one of the two base members; wire shaped member mounted inside the vacuumed envelope; and a first and a second spacers, made of a metal, for supporting the wire shaped member at a predetermined height with reference to said one of the two base members, wherein one end portion of the wire shaped member is wound around the first spacer to be supported at the predetermined height and is interposed between the first spacer and the first metal layer to be fixed thereto, and the other end portion of the wire shaped member is supported at the predetermined height by the second spacer and is fixed to the second metal layer.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1A:
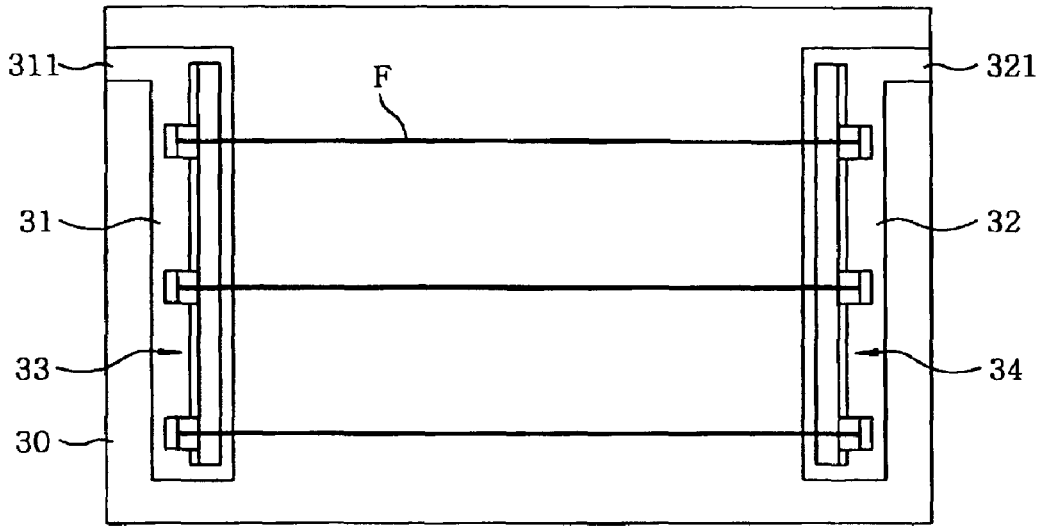
FIG. 1A (PRIOR ART)
FIGS. 1A to 1C show various views of a first prior art fluorescent display tube.
Figure 1B:
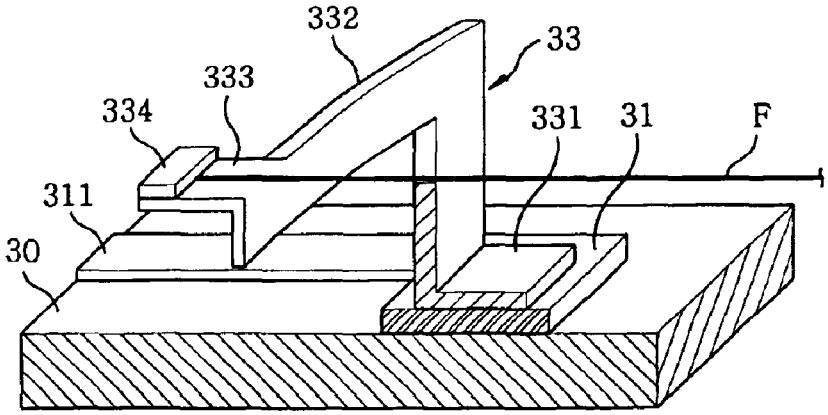
FIG. 1B (PRIOR ART)
Figure 1C:
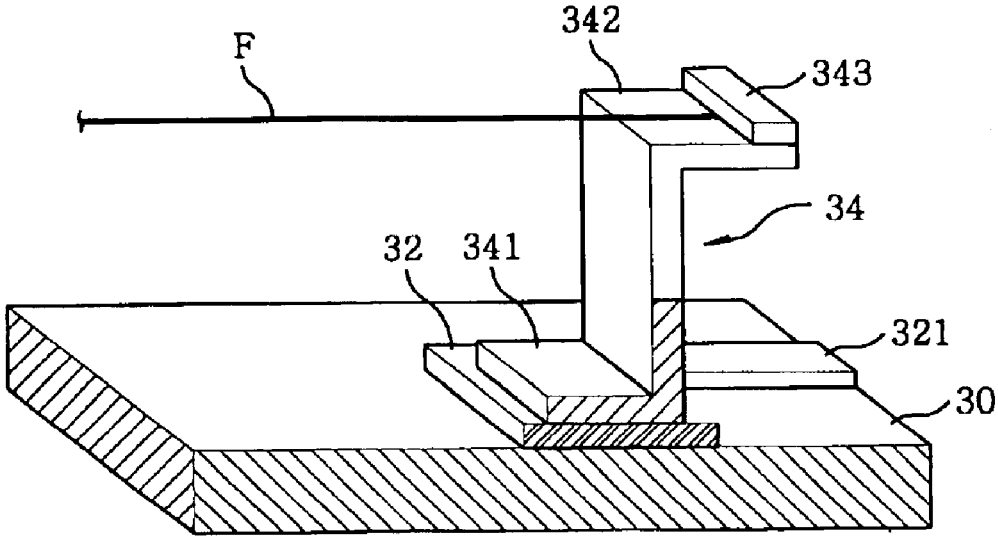
FIG. 1C (PRIOR ART)

Preferred embodiments of the present invention will now be described with reference to FIGS. 3A to 14C. Like reference numerals in FIGS. 3A to 14C represent like parts.

Figure 3A:
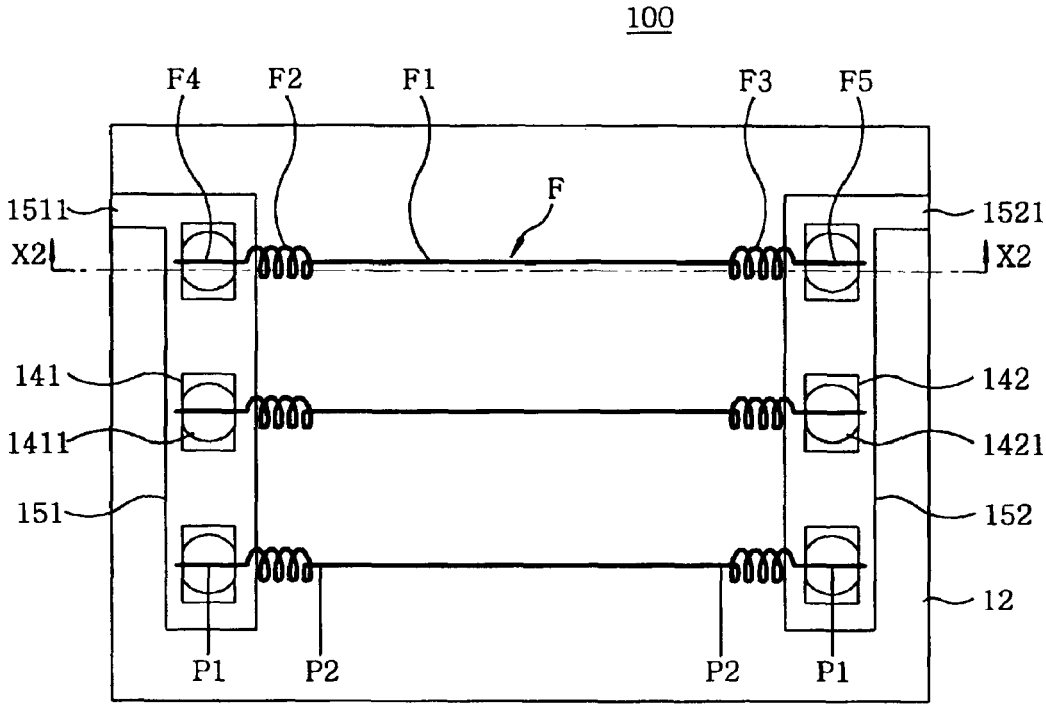
FIGS. 3A to 3B offer a top view and a cross sectional view of a fluorescent display tube in accordance with a first preferred embodiment of the present invention.
Figure 3B:
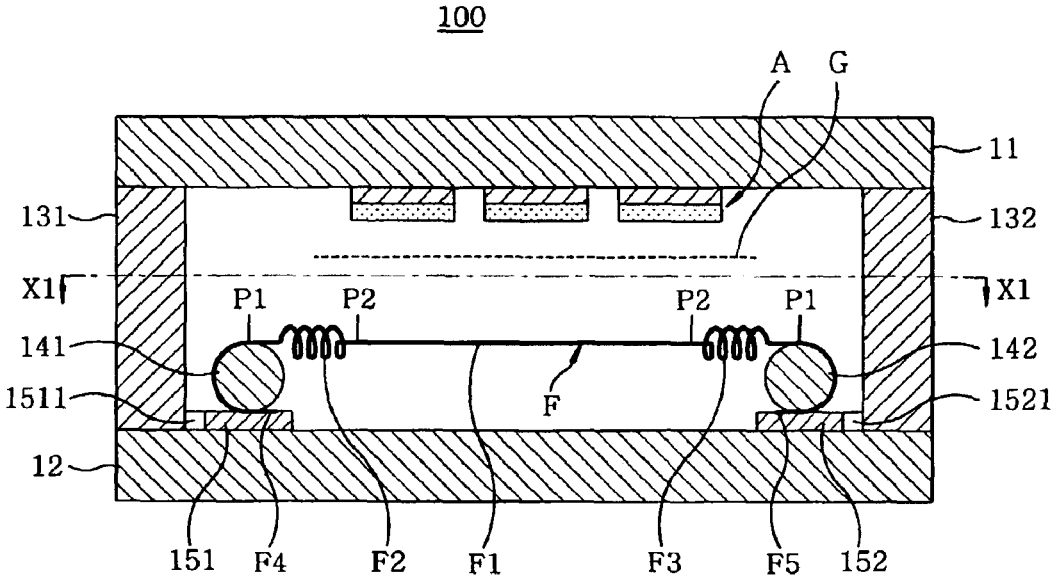

There are shown in FIGS. 3A to 3B a top view of a fluorescent display tube 100 in accordance with a first preferred embodiment of the present invention and a cross sectional view thereof taken along the line X2—X2 in FIG. 3A. FIG. 3A corresponds to a cross sectional view taken along the line X1—X1 in FIG. 3B and side plates are omitted therein for the sake of simplicity.

As shown, a reference numeral 11 represents an anode substrate (a first base member) made of an insulating material such as a glass, a ceramic or the like; 12, a front substrate (a second base member) made of a glass or the like; 131 and 132, side plates (side members) respectively made of a glass or the like; A, anode electrodes (anodes) coated with a fluorescent material; G, a grid; F, cathode filaments (cathodes); 141 and 142, supporting members (fixing members) for supporting one of the filaments F at a predetermined vertical position; 1411 and 1421, mounting areas (fixing areas); 151 and 152, cathode electrodes; and 1511 and 1521 are cathode wirings. The anode substrate 11, the front substrate 12, and the side plates 131 and 132 are hermetically sealed by a fritted glass (not shown) or the like, forming a vacuumed envelope of the fluorescent display tube 100. The supporting members 141 and 142 are installed for every filament F. Further, a tin based oxide film such as an ITO is usually formed on the front substrate 12, but is omitted in the drawings.

Further, each of the side plates 131 and 132 can be formed as a single body with the anode substrate 11 and/or the front substrate 12.

The supporting members 141, 142 are made of aluminum wires, and the cathode electrodes 151, 152 and the cathode wirings 1511, 1521 are made of thin aluminum films. Each filament F has a linear portion F1, coiled portions (tensile force applying portions) F2 and F3, end portions F4 and F5, and has a core wire, made of tungsten, a rhenium and tungsten alloy or the like, coated with a material, such as ternary carbonate, for emitting thermal electrons.

The end portions (fixed portions) F4 and F5 of each filament F are respectively wound halfway along the circumferences of the supporting members 141 and 142, and are then interposed between an ultrasonic bonding tool (to be described hereinafter) and the cathode electrodes 151 and 152, wherein the ultrasonic bonding tool ultrasonically bonds the end portions F4, F5 and supporting members 141, 142 on the mounting areas 1411, 1421 by applying ultrasonic waves thereto. Therefore, the cathode electrodes 151 and 152 also function as mounting members of the supporting members 141 and 142. The coiled portions F2, F3 of each filament F are located in the so-called end cool zones, i.e., between P1 and P2, wherein P1's are points where the end portions F4, F5 start to make contact with the supporting members 141, 142 and P2's are end points of the linear portions F1. In each filament F, the coiled portions F2 and F3 exert a tensile force on the linear portions F1.

Further, the end portions F4 and F5 of each filament F are respectively stuck into the supporting members 141 and 142 made of aluminum, which is softer than the core wire of the filaments F, by ultrasonic bonding.

Since the vertical position of each filament F is determined by the diameter of the bonded supporting members 141 and 142 (i.e., the height of the supporting members 141 and 142), the linear portion F1 of each filament F can be sustained at a predetermined vertical position by using the aluminum wire having a selected diameter.

In FIGS. 3A to 3B, each filament F preferably has 15 to 20 $\mu$m in diameter and the supporting members 141 and 142 are made of aluminum wires having a diameter of 300 to 500 μm. Because diameters of the supporting members 141 and 142 are equal to or greater than 20 times that of a filament F, the thickness of the supporting members 141 and 142 is barely affected by the presence of the end portions F4 and F5 of the filament F bonded and wound around the supporting members 141 and 142.

Figure 2A:
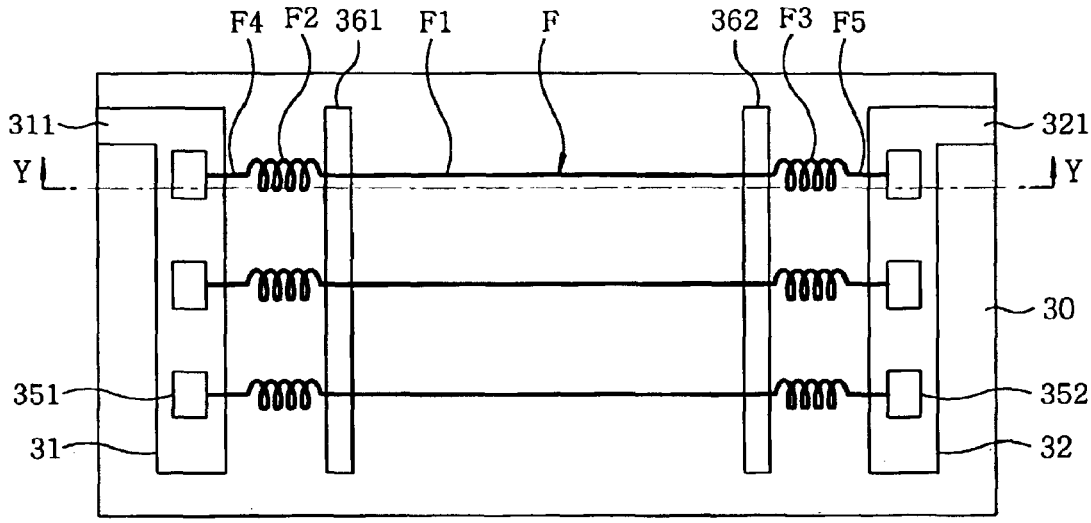
FIG.2A (PRIOR ART)
FIGS. 2A to 2C describe a partial view and a cross sectional view of a second prior art fluorescent display tube, and a graph for illustrating a temperature profile of a filament.
Figure 2B:
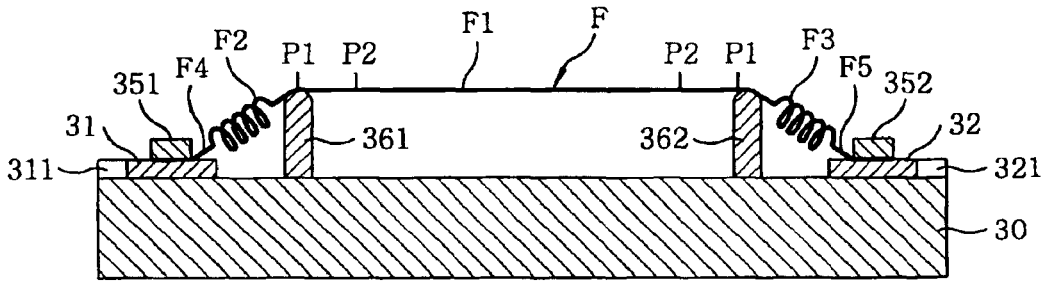
FIG.2B (PRIOR ART)
Figure 2C:
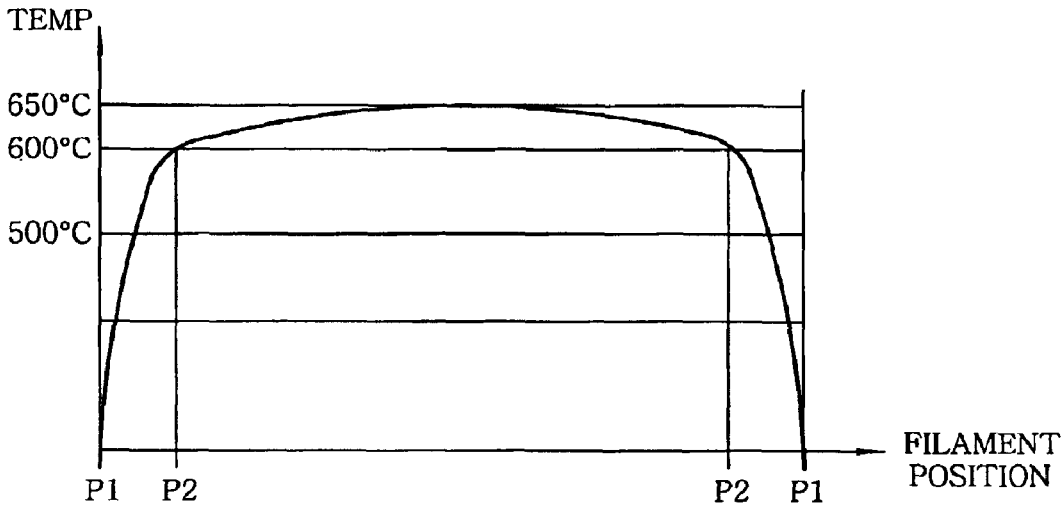
FIG.2C (PRIOR ART)

In case of FIGS. 3A and 3B, spaces for installing conventional spacers become unnecessary since the supporting members 141 and 142 also function as the conventional spacers shown in FIG. 2B. Further, since the coiled portions F2 and F3 of each filament F are located within the end cool zones, spaces occupied by the conventional coiled portions F2 and F3 between the supporting members and the spacers are unnecessary. Therefore, dead spaces required in the fluorescent display tube 100 in FIGS. 3A and 3B are only those for the provision of supporting members 141 and 142. Conventional dead spaces are (1.0 mm to 1.5 mm)*2 in length, whereas dead spaces in the fluorescent display tube 100 are reduced down to (300 to 500 μm)*2 corresponding to the thickness of the supporting members 141 and 142. Further, since the supporting members 141 and 142 are formed of aluminum wires and directly attached to the cathode electrodes 151 and 152 made of thin aluminum film, the fluorescent display tube 100 can be further scaled down and made slimmer.

Further, because the supporting members 141 and 142 are fixed by ultrasonic waves, the cathode electrodes 151, 152 or the cathode wirings 1511, 1521 near to the mounting areas 1411 and 1412 will not be damaged and the front substrate 12 can be also protected from a crack which can be developed by heat otherwise. And, the filament mounting process becomes simple. Moreover, because the end portions F4 and F5 of each filament F are wound halfway around the circumference of the supporting members 141 and 142, respectively, the end portions F4, F5 can be tightly fixed thereto.

Figure 4:
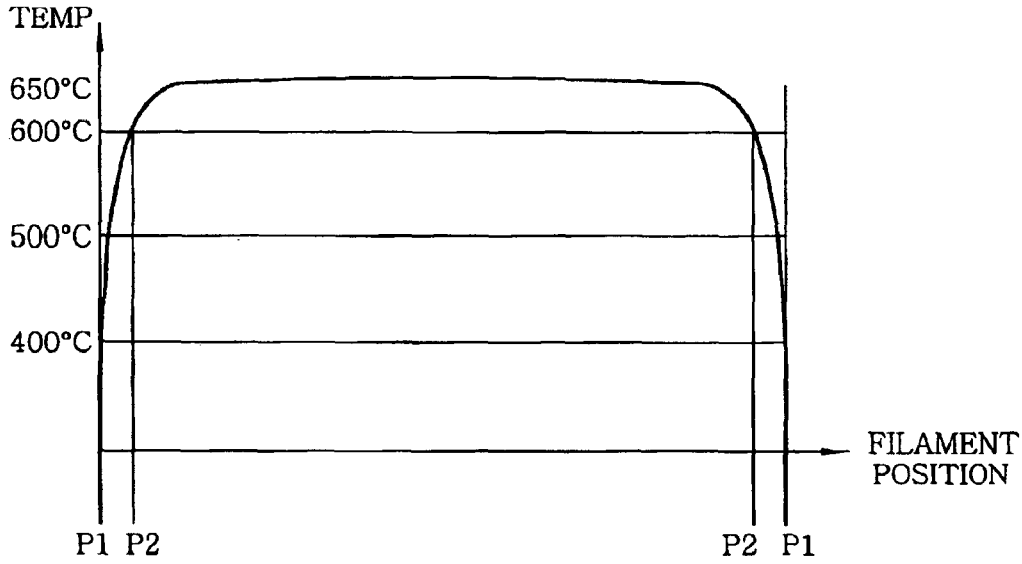
FIG. 4 provides a graph for illustrating a temperature profile of a filament in the fluorescent display tube shown in FIGS. 3A and 3B.

Referring to FIG. 4, there is illustrated a temperature profile of one of the filaments F in the fluorescent display tube 100. The horizontal axis represents a lengthwise position in the filament F and the vertical axis represents a temperature of the filament F. The reference numerals P1's represent places where the end portions F4 and F5 start to make contact with the supporting members 141 and 142, and the reference numerals P2's represent both ends of the linear portion F1, which is kept at 600° C.

The heat generated by the filament F is dissipated by the supporting members 141 and 142, lowering the temperature in sections P1–P2 of the filament F. The sections P1–P2 are the so-called "end cool zones", where emission of thermal electrons is absent or insufficient, and therefore do not contribute to the display. The filament zone contributing to the display is a section P2—P2 (i.e., the linear portion F1), wherein the filament F is driven such that the linear portion F1 is maintained at 600 to 650° C. in temperature.

The end cool zones inevitably occur in all fluorescent display tubes if a filament of the thermal electron emission type is used. Therefore, it is an important issue to minimize the end cool zones in order to enlarge the effective display area. In the fluorescent display tube 100 shown in FIGS. 3A and 3B, the coiled portions F2 and F3 are located within the sections P1–P2, so that the end cool zones in accordance with the present invention can be reduced in size compared to the conventional end cool zones.

Further, since the wire length of the coiled portions F2 and F3 (i.e., a stretched length of coiled portions F2 and F3) is greater than the length of the coiled portions F2 and F3 (i.e., the width of coils), the amount of heat generated from the coiled portions F2 and F3 is large. In addition, because the coils in the coiled portions F2 and F3 is heated by radiant heat of their adjacent coils, the rate at which the temperature rises in the coiled portions F2 and F3 is higher than that in the linear portion F1. As a result, the sections P1–P2 of a coiled type can be reduced in length compared to those of a linear type. For example, in case where the filament F has about 15 μm in diameter and each of the coiled portions F2 and F3 is about 5 mm in length (i.e., a width of the coils) and 100 μm in coil pitch, the sections P1–P2 of the end cool zones are respectively reduced down to about 5 mm in length, which is approximately a half of the conventional end cool zones (about 10 mm). Therefore, the effective display area can be enlarged by as much as an area of the scaled down of the end cool zones.

In case of FIGS. 3A and 3B, the coiled portions F2 and F3 of the filament F are disposed within the end cool zones of the sections P1–P2, so that the power wasted in the conventional coiled portions F2 and F3 (e.g., shown in FIG. 2B) can be used for an improvement of the end cool effect and at the same time the dead spaces can be reduced down as mentioned above.

Figure 5:
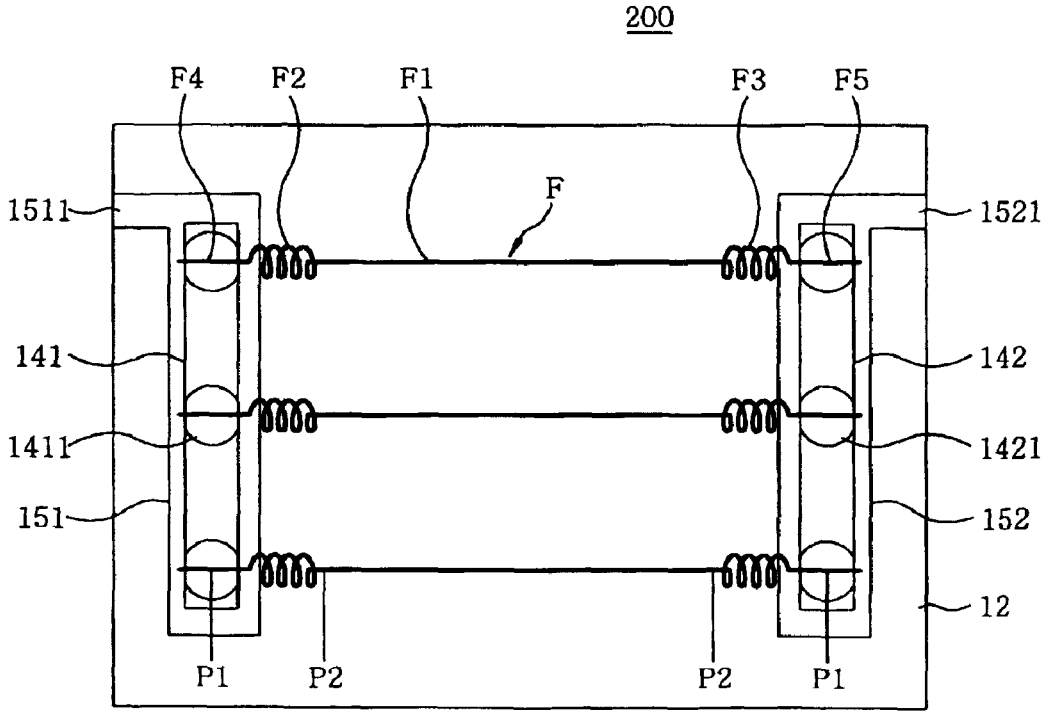
FIG. 5 presents a top view of a fluorescent display tube in accordance with a second preferred embodiment of the present invention.

FIG. 5 provides a top view of a fluorescent display tube 200 in accordance with a second preferred embodiment of the present invention. The fluorescent display tube 200 is similar to the fluorescent display tube 100 excepting for structure of the supporting members 141 and 142.

A pair of the supporting members 141 and 142 of the fluorescent display tube 100 shown in FIG. 3A is installed for every single filament F, whereas a pair of the supporting members 141 and 142 of the fluorescent display tube 200 is used for all three filaments F. In case of FIG. 5, three filaments F are bonded to the cathode electrodes 151 and 152 at the same time by using an ultrasonic bonding tool (to be described hereinafter), thereby saving time required for a bonding process. Further, when a portion of the cathode electrode is damaged or the thin cathode electrode do not have enough current capacity, the supporting members can serve to supplement functions of the cathode electrode.

Other features and effects of the florescent display tube 200 are identical to those of the florescent display tube 100.

Figure 6A:
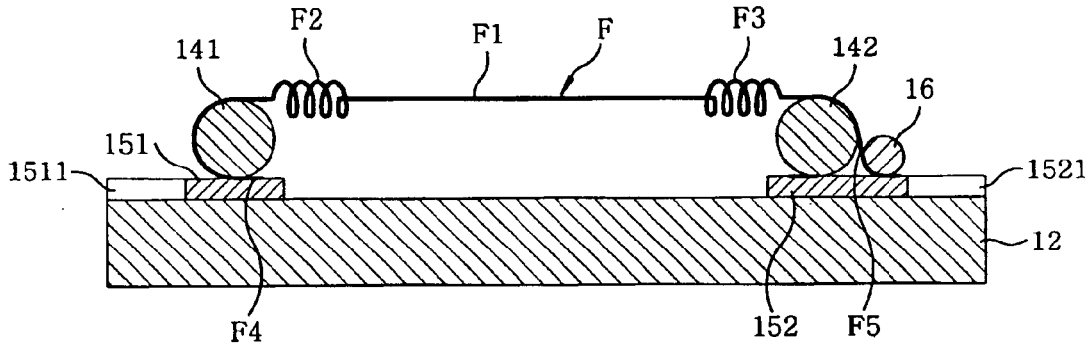
FIGS. 6A to 6B depict cross sectional views for illustrating variations of the fixing scheme of a filament shown in FIGS. 3A, 3B and 5.
Figure 6B:
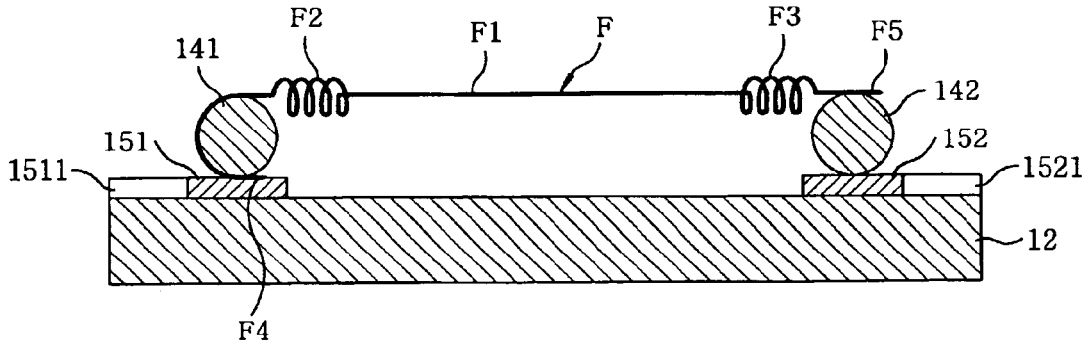

FIGS. 6A and 6B depict cross sectional views for illustrating variations of the fixing scheme of a filament F in FIGS. 3A, 3B and 5.

In case of FIG. 6A, the end portion F4 of the filament F is wound around the supporting member 141 on the cathode electrode 151. However, on the cathode electrode 152, the filament F makes contact with the supporting member 142 functioning as a spacer of the filament F and is sustained at a predetermined vertical position, but the end portion F5 of the filament F is fixed to the cathode electrode 152 together with an aluminum wire 16 (or a metallic wire) by ultrasonic bonding. In this case, since the end portion F5 is disposed and bonded beneath the aluminum wire 16, the bonding process can be easily performed. In such case, a space is needed for accommodating the aluminum wire 16. Since, however, the aluminum wire 16 simply serves to fix the filament F without functioning as a spacer, the aluminum wire 16 can be thinner than the supporting member 142 (of 300 to 500 μm in diameter) Accordingly, the additional space for the aluminum wire 16 can be negligible.

In case of FIG. 6B, the supporting member 142 and the end portion F5 without winding around the supporting member 142 are ultrasonically bonded to the cathode electrode 152. In this case, a bonding strength may be somewhat weaker than that in the case where the end portion F5 of the filament F is wound around the supporting member 142, but the bonding process can be simple.

In FIGS. 6A and 6B, the end portion F5 of the filament F is also stuck into the supporting member 142 made of aluminum, which is softer than the core wire of the filament F, by ultrasonic bonding.

Figure 7A:
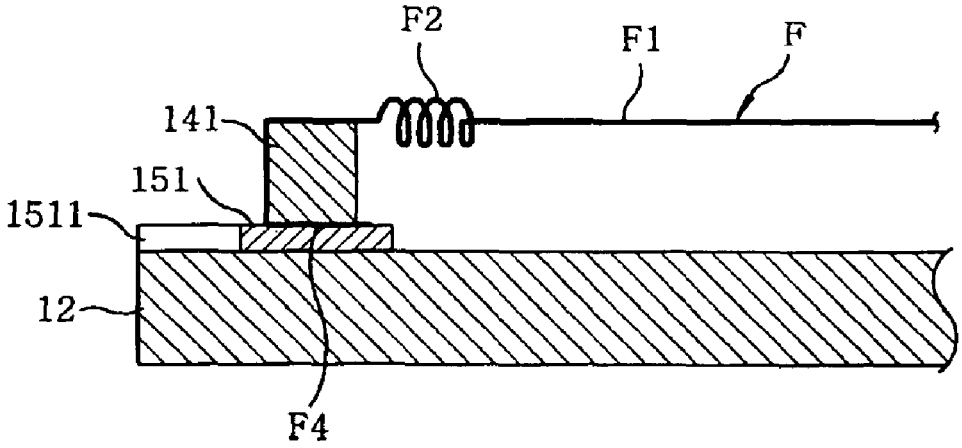
FIGS. 7A to 7B represent cross sectional views for illustrating modifications in a supporting member.
Figure 7B:
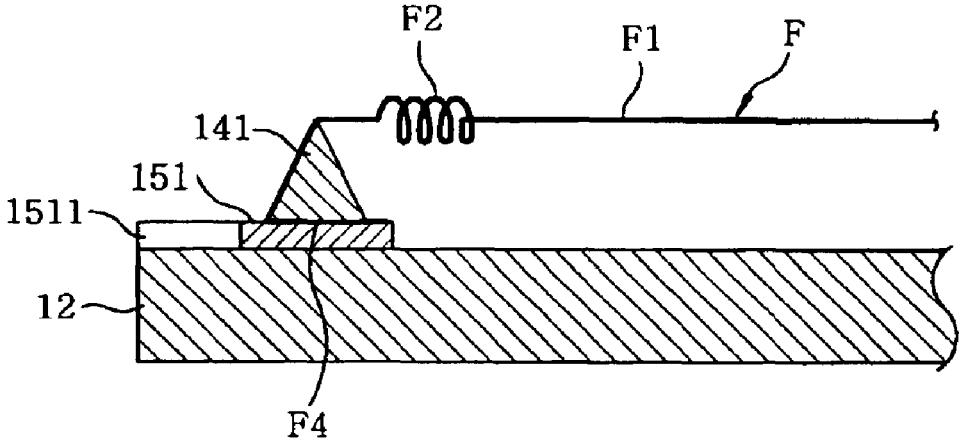

FIGS. 7A and 7B show cross sectional views for illustrating modifications of the supporting members 141 and 142, wherein only the supporting member 141 will be described for illustration purpose.

FIGS. 7A and 7B represent the supporting member 141 whose cross sections are a quadrangle (a square) and a triangle, respectively. Since a bottom of the supporting member 141 is flat in both FIGS. 7A and 7B, the bonding process can be more stably and readily performed here than in the case of a supporting member having a round surface. Further, the cross section of the supporting member 141 may be a rectangle, a trapezoid or a polygon having more than four sides. Also, the cross section of the supporting member 141 can have curved sides as long as the bottom surface thereof is flat.

Figure 8A:
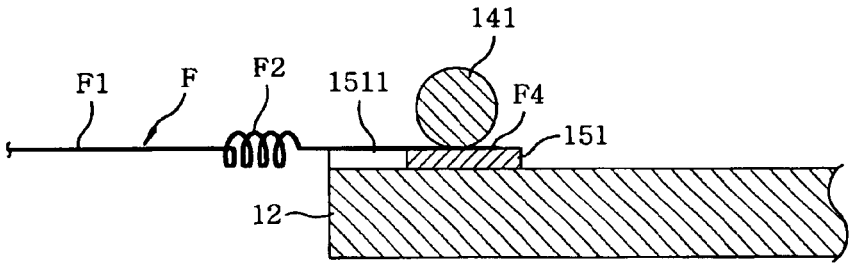
FIGS. 8A to 8C show cross sectional views for illustrating mounting process of a filament shown in FIGS. 3A, 3B and 5.
Figure 8B:
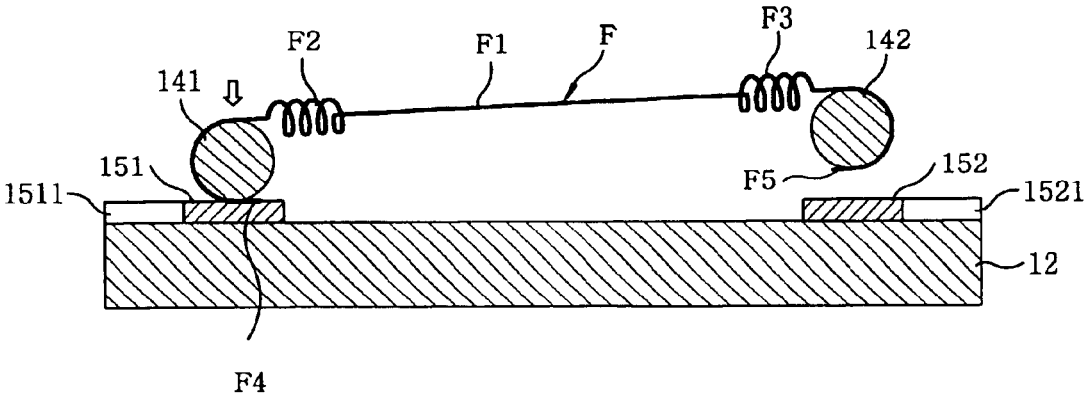
Figure 8C:
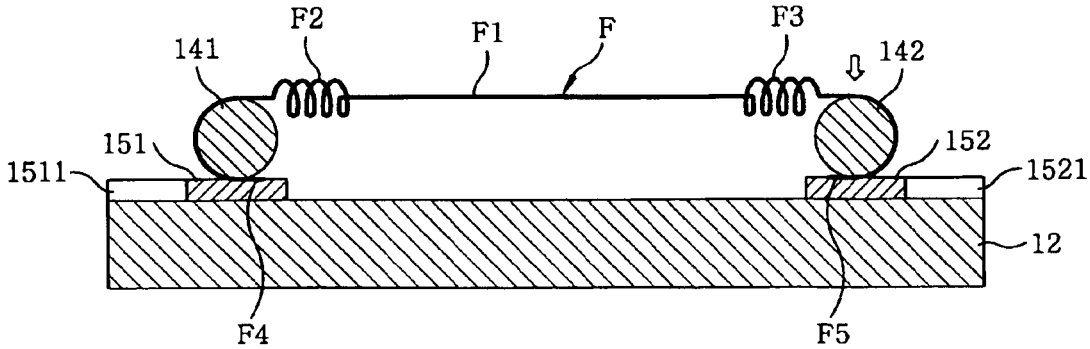

FIGS. 8A to 8C offer cross sectional views for illustrating mounting process of the filament F in FIGS. 3A to 3B and 5.

First, the end portion F4 of the filament F is interposed between the supporting member 141 and the cathode electrode 151 as shown in FIG. 8A. Next, as shown in FIG. 8B, the end portions F4 and F5 of the filament F are wound around the supporting members 141 and 142, respectively, and then the end portion F4 of the filament F with the supporting member 141 is contacted to and compressed by an ultrasonic bonding tool (to be described hereinafter) in the direction of an arrow. Subsequently, the end portion F4 and the supporting member 141 are ultrasonically bonded to the cathode electrode 151 by applying ultrasonic waves thereto from the ultrasonic bonding tool.

Alternatively, when the end portion F4 of the filament F is interposed between the supporting member 141 and the cathode electrode 151 as shown in FIG. 8A, it is possible that the end portion F4 of the filament and the supporting member 141 are ultrasonically bonded to the cathode electrode 151.

Finally, as shown in FIG. 8C, the end portion F5 with the supporting member 142 is contacted to and compressed by the ultrasonic bonding tool in the direction of an arrow. Subsequently, the end portion F5 and the supporting member 142 are ultrasonically bonded to the cathode electrode 152 by applying ultrasonic waves thereto from the ultrasonic bonding tool. At this time, a tensile force needs to be applied to the linear portion F1 in such a way that the end portion F5 and the supporting member 142 are together drawn to a right side of the drawing (i.e., toward the cathode wiring 1521) when performing the ultrasonic bonding, so that the linear portion F1 can be tightly suspended without being sagged.

FIGS. 9A to 9D set forth cross sectional views for illustrating mounting process of filaments in FIGS. 6A and 6B.

Figure 9A:
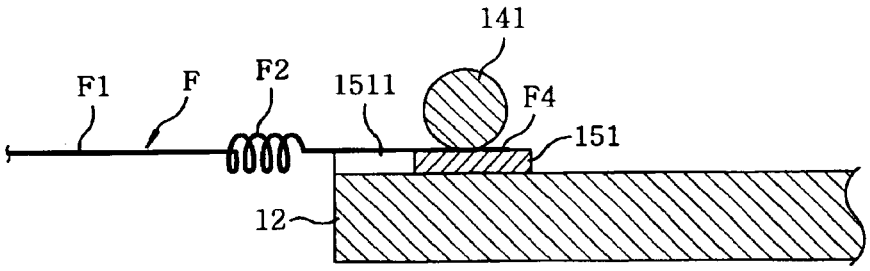
FIGS. 9A to 9D describe cross sectional views for illustrating mounting process of a filament shown in FIGS. 6A to 6B.
Figure 9B:
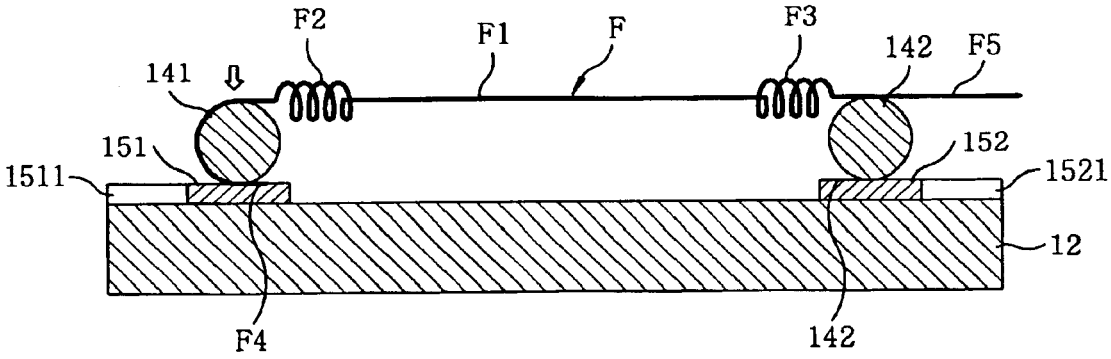

The end portion F4 of the filament F is interposed between the supporting member 141 and the cathode electrode 151 as shown in FIG. 9A. Next, as shown in FIG. 9B, the end portion F4 of the filament F is wound around the supporting member 141, and then the end portion F4 and the supporting member 141 are contacted to and compressed by the ultrasonic bonding tool in the direction of an arrow. Subsequently, the end portion F4 with the supporting member 141 is ultrasonically bonded to the cathode electrode 151 by applying ultrasonic waves thereto from the ultrasonic bonding tool.

Alternatively, when the end portion F4 of the filament F is interposed between the supporting member 141 and the cathode electrode 151 as shown in FIG. 9A, the end portion F4 of the filament F may be ultrasonically bonded to the cathode electrode 151 together with the supporting member 141.

Figure 9C:
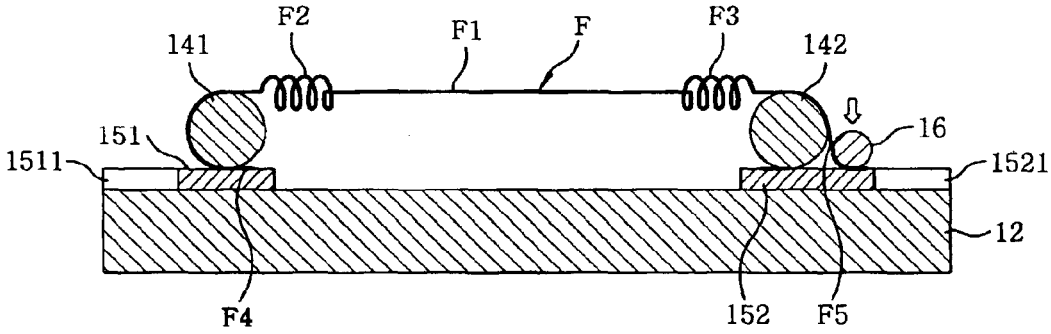

Next, as shown in FIG. 9C, the supporting member 142 is ultrasonically bonded to the cathode electrodes 152 and then the aluminum wire 16 is contacted to and compressed by an ultrasonic bonding tool in the direction of an arrow in such a manner that the end portion F5 is pushed underneath the aluminum wire 16. Subsequently, the end portion F5 and the aluminum wire 16 is ultrasonically bonded to the cathode electrode 152 by applying ultrasonic waves thereto from the ultrasonic bonding tool. At this time, a tensile force needs to be applied to the linear portion F1 in such a way that the end portion F5 is pulled toward a right side of the drawing (i.e., toward the cathode wiring 1521) when performing the ultrasonic bonding, thereby making the linear portion F1 be tightly pulled without sagging.

Figure 9D:
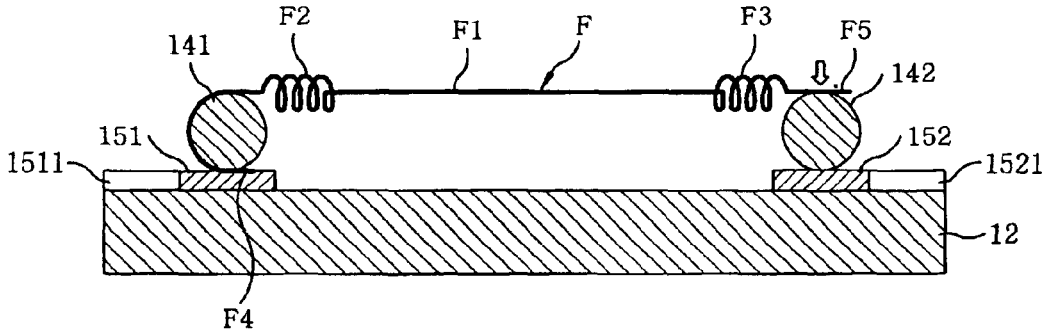

In FIG. 9D, the end portion F5 is not wound around the supporting member 142. The end portion F5 and the supporting member 142 are contacted to and compressed by the ultrasonic bonding tool in the direction of an arrow, to be ultrasonically bonded to the cathode electrode 152. Or, the supporting member 142 might be ultrasonically bonded to the cathode electrode 152 in advance, and thereafter the end portion F5 of the filament F can be ultrasonically bonded thereto. At this time, a tensile force needs to be exerted on the linear portion F1 in such a way that the end portion F5 is pulled toward the cathode wiring 1521 when performing the ultrasonic bonding, so that the linear portion F may not be loose.

As described, the end portion F5 of the filament F is stuck into the supporting member 142 made of aluminum, which is softer than the core wire of the filament F, by an ultrasonic bonding. To put it in detail, most parts of the core wire of the filament F are stuck into the supporting member 142 while partially exposing an upper portion thereof.

Figure 10A:
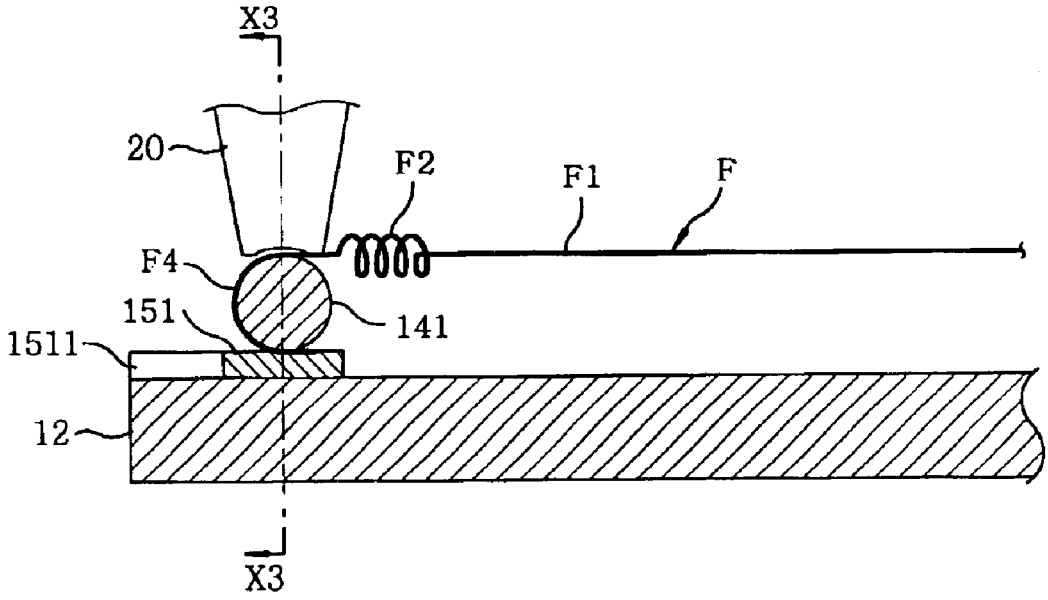
FIGS. 10A and 10B offer partial cross sectional views for illustrating an ultrasonic bonding tool and the bonding process.
Figure 10B:
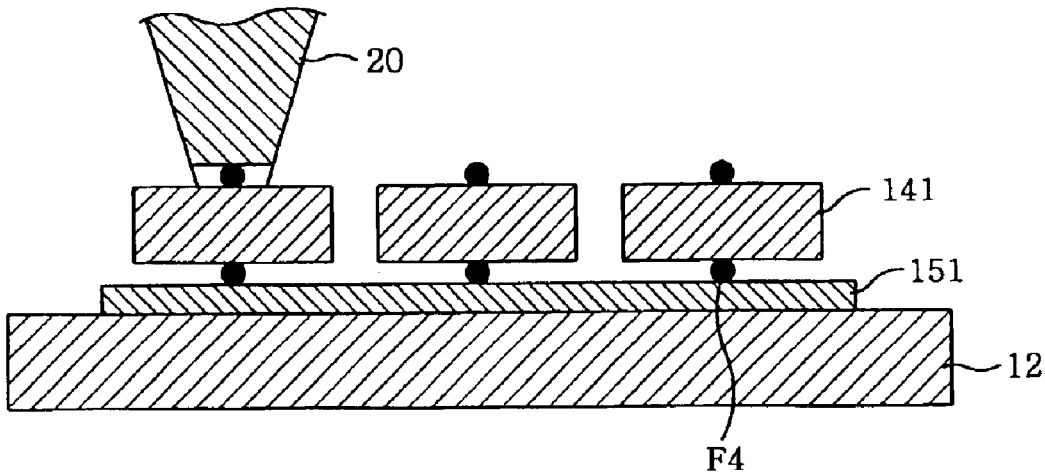

FIGS. 10A and 10B present partial cross sectional views illustrating an ultrasonic bonding tool 20 and a bonding process, wherein FIG. 10B is taken along the line X3—X3 in FIG. 10A and a supporting member 141 supports only one filament F.

The ultrasonic bonding tool 20 has a round or a V-shaped groove in its tip portion. The groove of the ultrasonic bonding tool 20 presses the end portion F4 and the supporting member 141 to apply ultrasonic waves thereto. In this case, the ultrasonic bonding tool 20 sequentially carries out the bond process against one filament F at a time.

Figure 11A:
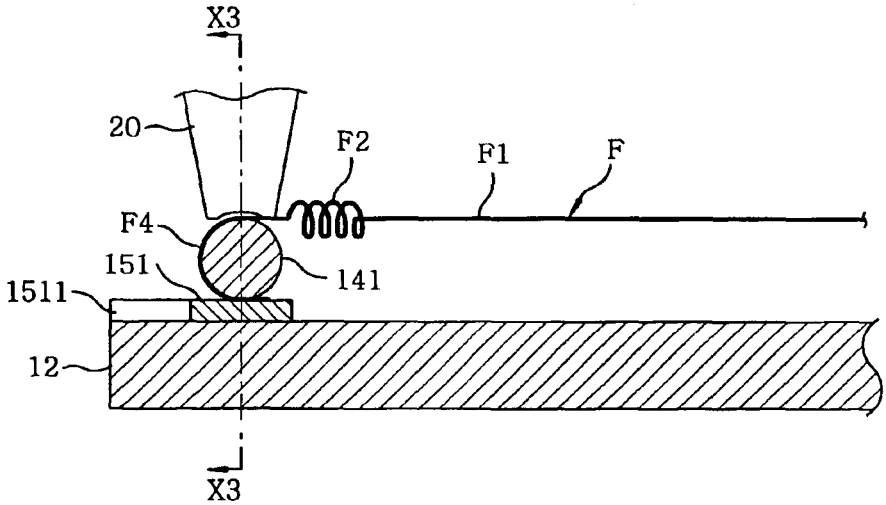
FIGS. 11A to 11C present partial cross sectional views of an alternative ultrasonic bonding tool and the bonding process thereof.
Figure 11B:
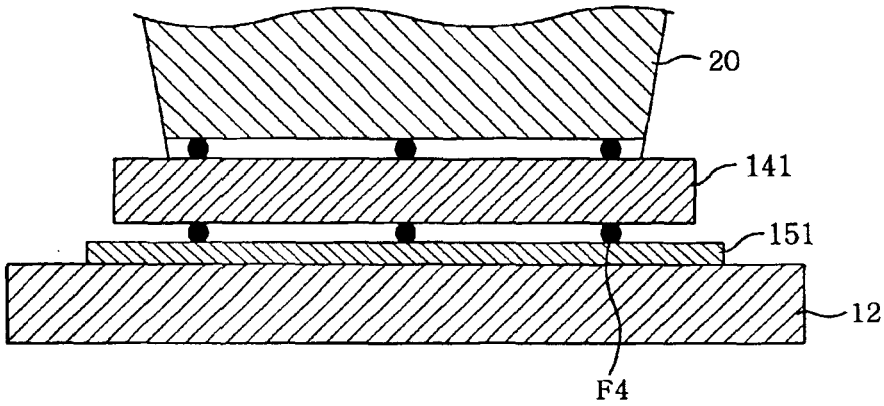
Figure 11C:
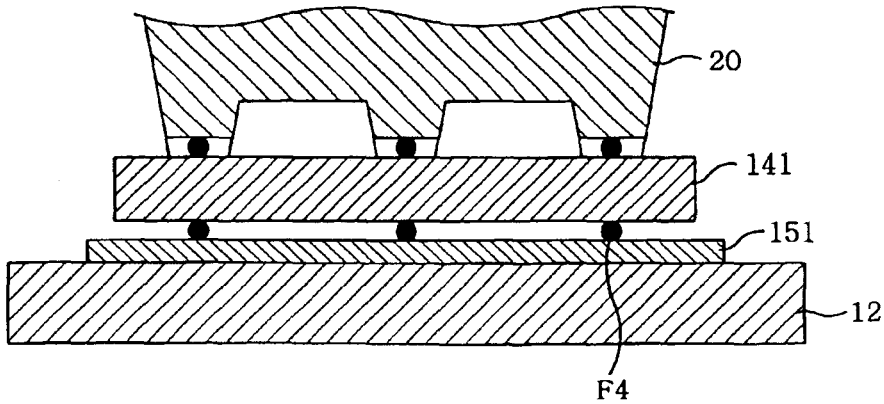

FIGS. 11A to 11C are partial cross sectional views of an alternative ultrasonic bonding tool 20 and the bonding process thereof, wherein FIGS. 11B and 11C show cross sectional views taken along the line X3—X3 in FIG. 11A and the ultrasonic bonding tool 20 in FIG. 11C and FIG. 11C is a modification of that in FIG. 11B. In FIGS. 11A to 11C, one supporting member 141 is used for more than one filament F.

In FIG. 11B, a width of the ultrasonic bonding tool 20 (a length along the longitudinal direction of the supporting member 141 which is used for all three filaments F) is large enough to cover the three filaments F. The ultrasonic bonding tool 20 has a round or a V-shaped groove in its tip portion. The groove of the ultrasonic bonding tool 20 presses the end portions F4 of the filaments F and the supporting member 141 to apply ultrasonic waves thereto. In this case, the bonding time can be saved since the three ultrasonic bonding tool 20 bonds the three filaments F at the same time.

The ultrasonic bonding tool 20 in FIG. 11C has three protrusions of a comb shape provided at locations corresponding to the three filaments F. Each of the protrusions has a round or a V-shaped groove at its tip portion. In this case, the three filaments F can be bonded at the same time as in FIG. 11B. Further, since the supporting member 141 is bonded only at the positions to which the protrusions of the ultrasonic bonding tool are directly attached, the output power of the ultrasonic bonding tool 20 in FIG. 11C can be less than that in FIG. 11B.

Alternatively, the ultrasonic bonding tool 20 in FIGS. 11A to 11C may also be configured to bond the filaments F one at a time as in FIGS. 10A to 10B.

Figure 12A:
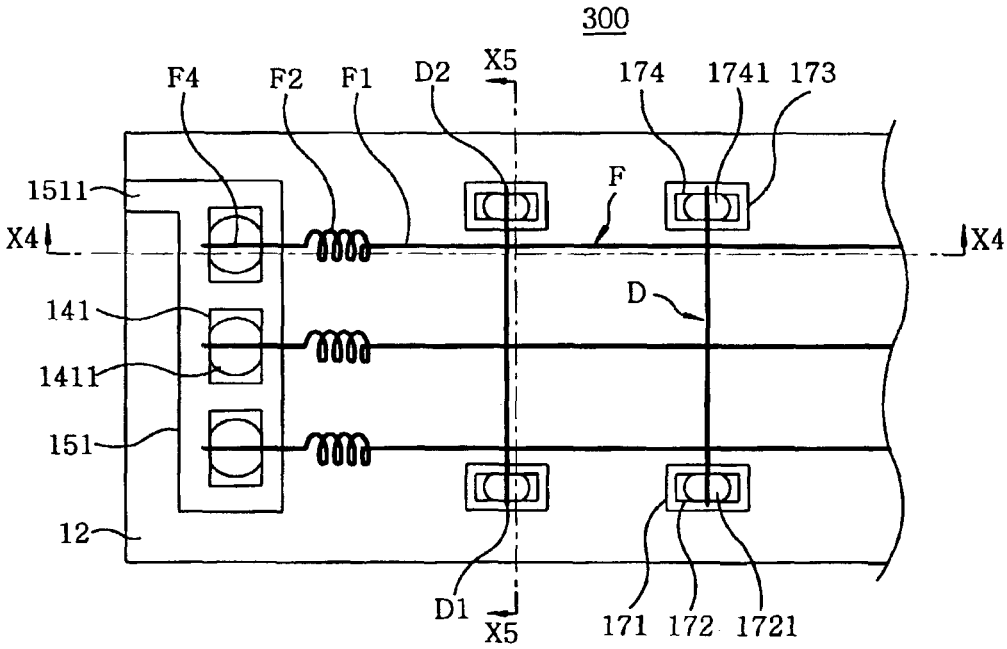
FIGS. 12A to 12C describe various views of a fluorescent display tube in accordance with a third preferred embodiment of the present invention.
Figure 12B:
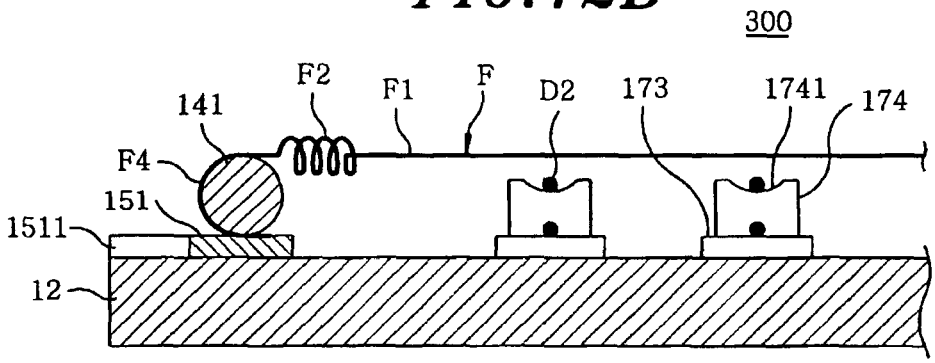
Figure 12C:
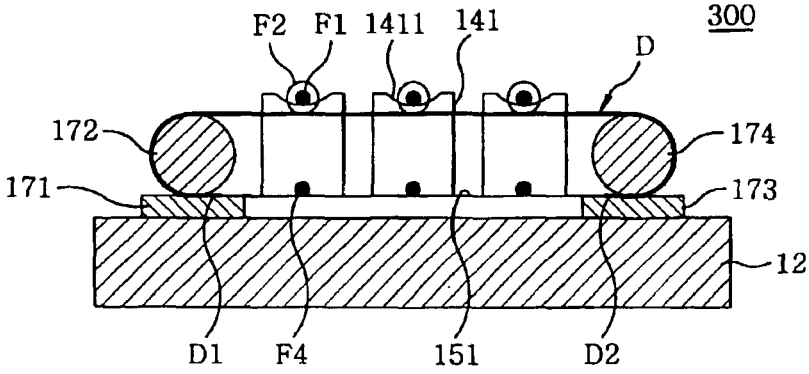

FIGS. 12A to 12C describe various views of a fluorescent display tube 300 whose front substrate 12 mounts thereon a plurality of filaments F and a multiplicity of dampers D in accordance with a third preferred embodiment of the present invention, wherein FIG. 12A is a plan view thereof; FIG. 12B is a cross sectional view taken along the line X4—X4 in FIG. 12A; and FIG. 12C is a cross sectional view taken along the line X5—X5 in FIG. 12A.

In the drawings, the reference numeral D represents a damper of the filament F; D1 and D2, end portions thereof; 172 and 174, supporting members for supporting the dampers D at a preset vertical position; 171 and 173, aluminum films for mounting the supporting members 172 and 174 thereon; and 1721 and 1741 are mounting areas. The supporting members 172 and 174 of the damper D are made of an identical material to that of the supporting member 141 of the filament F. The damper D is made of tungsten, molybdenum, stainless steel or the like.

The filaments F in the FIGS. 12A to 12C are identical to those in FIGS. 3A to 3B.

The dampers D are mounted below the filament F in such a way that, only when the filament F is vibrating, they are contacted with the filament F. Accordingly, the filament F is kept from touching other components, e.g., a grid G, in the fluorescent display tube 300, to thereby prevent the filament F from damaging or electrically short to other components. The end portions D1 and D2 and the supporting members 172 and 174 are ultrasonically bonded to the aluminum films 171 and 173, respectively, similarly to the end portion F4 of the filament F.

Further, the supporting members 172 and 174 may be not installed individually for every single damper D, but may be commonly shared among the dampers D.

Conventionally, there have been installed additional spacers, in addition to the supporting members 172 and 174, in order to sustain the dampers D at a preset height. Since, however, the supporting members 172 and 174 in accordance with the present embodiment also function as the conventional spacers, the dead space can be reduced. Other effects due to the ultrasonic bonding of the dampers D are similar to those of the filament F.

The dampers D may be mounted at a height lower than the filament F as in FIGS. 12B and 12C, but can be mounted at a height higher than the filament F as well. Also, the dampers D can be disposed around the two ends of the linear portion F1 of the filament F.

Figure 13A:
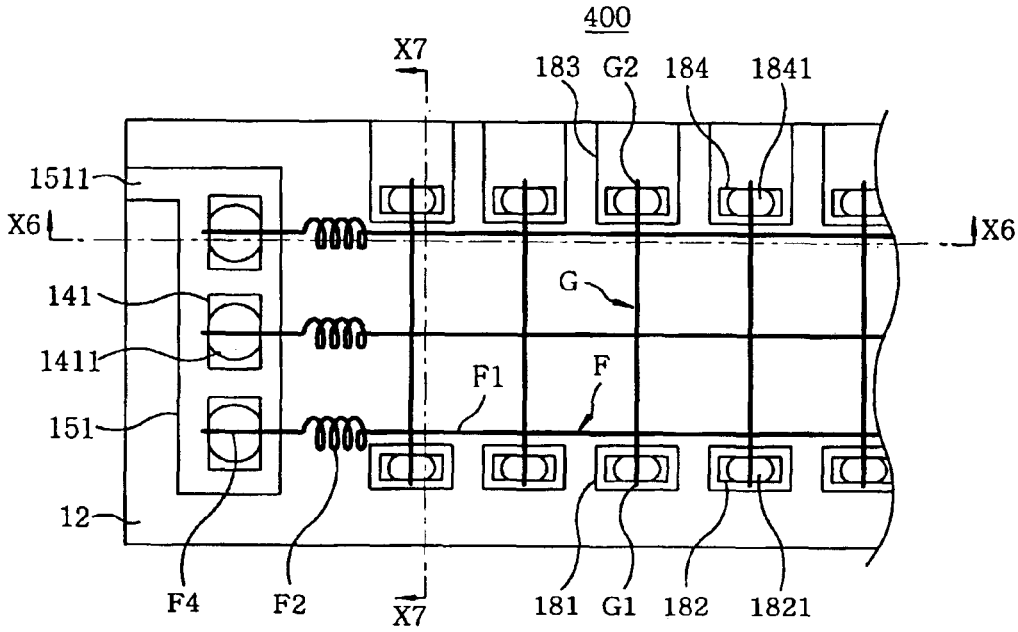
FIGS. 13A to 13C represent various views of a fluorescent display tube in accordance with a fourth preferred embodiment of the present invention.
Figure 13B:
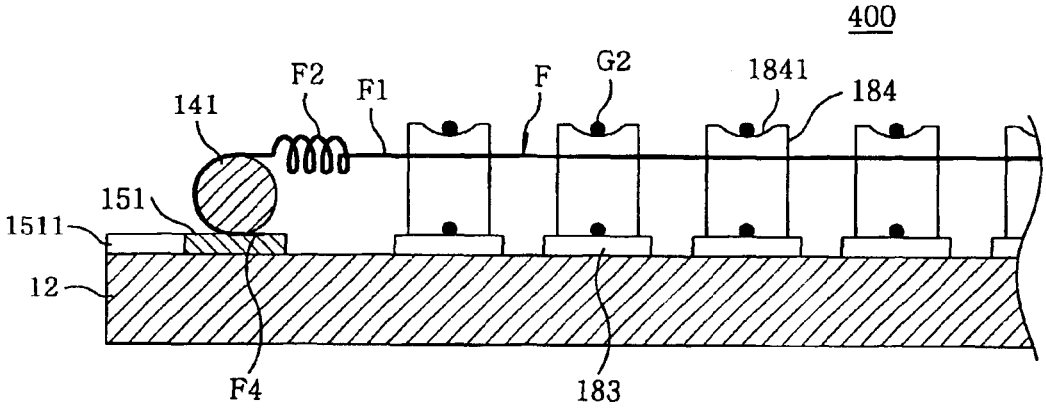
Figure 13C:
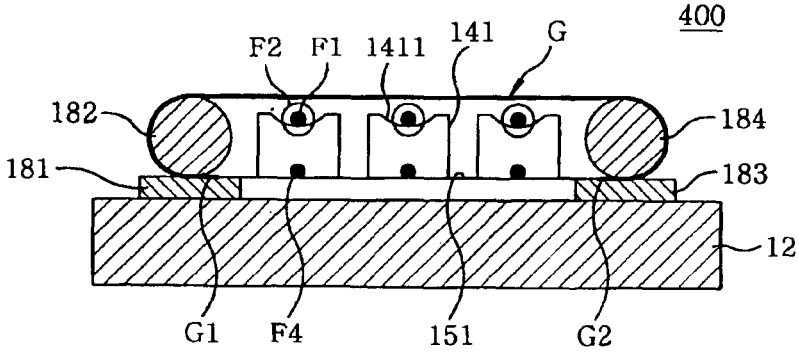

FIGS. 13A to 13C represent various views of a fluorescent display tube 400 whose front substrate 12 has a plurality of filaments F and a multiplicity of grids G mounted thereon in accordance with a fourth preferred embodiment of the present invention, wherein FIG. 13A is a plan view thereof; FIG. 13B is a cross sectional view taken along the line X6—X6 in FIG. 13A; and FIG. 13C is a cross sectional view taken along the line X7—X7 in FIG. 13A.

In the drawings, the reference numeral G represents a wire grid; G1 and G2, end portions thereof; 182 and 184, supporting members for supporting the wire grids G at a pre-established vertical position; 181, an aluminum film for mounting the supporting member 182 thereon; 183, an aluminum film, also functioning as a grid wiring, for mounting the supporting member 184 thereon; and 1821 and 1841 are mounting areas. The supporting members 182 and 184 of the wire grid G are made of an identical material to that of the supporting member 141 of the filament F. The wire grid G is made of SUS304, SUS430, YEF426 (so-called 426 alloy) or the like.

The filaments F in the FIGS. 13A to 13C are identical to those in FIGS. 3A to 3B.

The end portions G1 and G2 of the wire grid G and the supporting members 182 and 184 are ultrasonically bonded to the aluminum films 181 and 183, respectively, as the end portion F4 of the filament F.

Conventionally, there have been installed spacers, in addition to the supporting members 182 and 184, in order to support the wire grids D at a pre-established vertical position. Since, however, the supporting members 182 and 184 in accordance with the present embodiment also function as the conventional spacers, the dead space can be reduced. Other effects obtained by employing the ultrasonic bonding of the wire grid G are similar to those of the filament F.

Figure 14A:
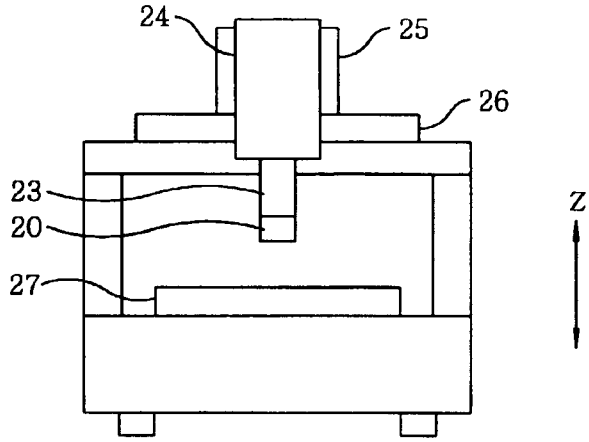
FIGS. 14A to 14C illustrate schematic diagrams of an ultrasonic bonding apparatus employed in the present invention.
Figure 14B:
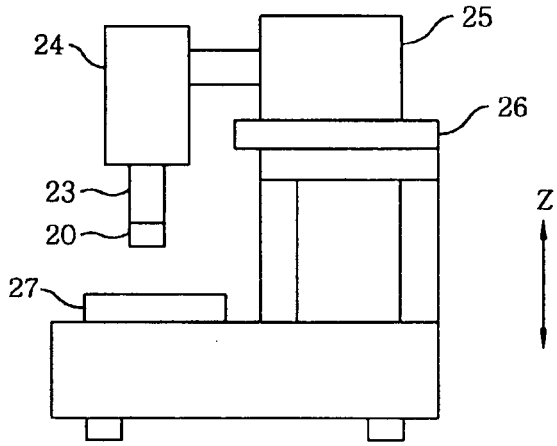
Figure 14C:
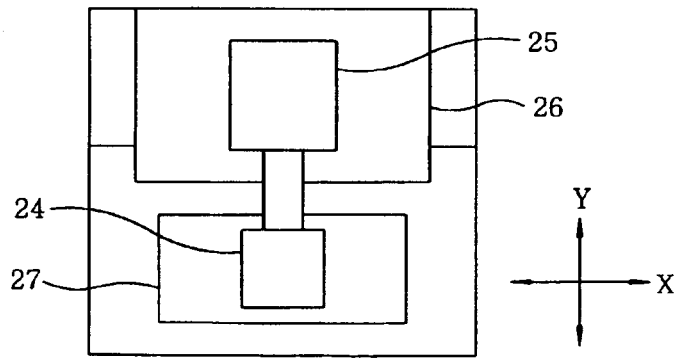

FIGS. 14A to 14C describe a schematic diagram of an ultrasonic bonding apparatus employed in the present invention. A conventional ultrasonic bonding apparatus may be used therefor, too.

FIGS. 14A to 14C represent a front view, a side view and a plane view of the ultrasonic bonding apparatus, respectively.

In the drawings, the reference numeral 23 represents a bonding tool holder; 24, a bonding tool driver; 25, a Z-axis stage; 26, an XY-axis stage; and 27, a front substrate folder.

The front substrate 12 mentioned above is set on the front substrate folder 27, and, in case of bonding a filament, the end portions F4 and F5 of one or more filaments F and their supporting members 141 and 142 are disposed on the cathode electrodes 151 and 152 of aluminum films, as shown FIGS. 8A to 9D. The bonding tool driver 24 then drives the bonding tool holder 23 and the bonding tool 20, to perform the ultrasonic bonding process. At this time, at the XY-axis stage 26, a position of the bonding tool holder 23 in the X-Y directions (the column row directions) is decided, and at the Z-axis stage 25, a position of the bonding tool holder 23 in the Z direction (the up and down directions) is decided. The Z-axis and the XY-axis stages 25 and 26 are driven under a control of a CPU in the ultrasonic bonding apparatus. The positional precision of the ultrasonic bonding is ±5 $\mu$m.

The damper D or the wire grid G can be similarly bonded as in the ultrasonic bonding of the filament F.

When the end portion of the filament is not wound around the supporting member, a bonding strength of the filament F whose core wire is made of tungsten having the diameter of, e.g., 15 $\mu$m is 20N, which is greater than a breaking strength of the tungsten. Therefore, if the end portions of the filament F are wound around the supporting members 141 and 142, the higher bonding strength can be obtained.

In each embodiment described above, the filament F, the damper D and the wire grid G are respectively fixed to their own supporting members. Such wire-type materials stretched at a predetermined vertical position are referred to as wire shaped members in the present invention.

In each embodiment, the fluorescence of the anode cathode A on the anode substrate 11 is observed through the front substrate 12. However, it is possible to observe the fluorescence through the anode substrate 11 if the anode electrode A is formed of a transparent electrode. In such case, the anode substrate 11 should be transparent as well and the front substrate 12 becomes a back substrate.

In the filament of each embodiment, the coiled portions for applying a tensile force are provided at both ends of the linear portion, but only one coiled portion can be provided at one end of the linear portion. Further, the whole filament may be formed of a coiled portion without having the linear portion. The coiled portion may also have other shape, e.g., a wavy shape, than the coil shape, as long as it can exert a tensile force.

In each embodiment, the wire shaped members are mounted on the front substrate, but they may be mounted on the anode substrate. Further, it is possible that, for example, the filaments and the dampers among the wire shaped members are mounted on the front substrate and the remaining members, i.e., wire members, are mounted on the anode substrate.

In each embodiment, the supporting members of the wire shaped members and their mounting members (i.e., the cathode electrodes) are made of aluminum, but they can be made of other metals, e.g., gold, silver, copper, niobium or the like, capable of being subjected to the ultrasonic bonding. Further, the mounting members may be made of metallic layers such as thick films or the like, in lieu of thin films.

The principles of the fluorescent display tube in accordance with the present invention may be equally applied to a fluorescent luminous tube for a printer head, a large screen display apparatus, a flat CRT or the like.

While the invention has been shown and described with respect to the preferred embodiment, it will be understood to those skilled in the art that various changes and modifications may be made without departing from the spirit and scope of the invention as defined in the following claims.

What is claimed is:

1. A fluorescent luminous tube, which includes a vacuumed envelope having two base members, an anode installed inside the vacuumed envelope, and a cathode arranged inside the vacuumed envelope, the fluorescent luminous tube comprising:

a first and a second metal layer formed on one of the two base members;

wire shaped member mounted inside the vacuumed envelope; and a first and a second spacer, made of a metal, for supporting the wire shaped member at a predetermined height with reference to said one of the two base members, wherein one end portion of the wire shaped member is wound around the first spacer to be supported at the predetermined height and is interposed between the first spacer and the first metal layer to be fixed thereto, and the other end portion of the wire shaped member is supported at the predetermined height by the second spacer and is fixed to the second metal layer.

2. The fluorescent luminous tube of claim 1, wherein the other end portion of the wire shaped member is wound around the second spacer to be supported at the predetermined height and is interposed between the second spacer and the second metal layer to be fixed thereto.

3. The fluorescent luminous tube of claim 1, wherein the other end portion of the wire shaped member is in contact with the second spacer fixed to the second metal layer to be supported at the predetermined height, and is interposed between the second metal layer and a metal wire to be fixed to the second metallic layer.

4. The fluorescent luminous tube of claim 1, wherein the other end portion of the wire shaped member is in contact with the second spacer fixed to the second metal layer to be supported at the predetermined height, and is mounted on the second spacer to be fixed to the second metal layer.

5. The fluorescent luminous tube of claim 1, wherein the wire shaped member is a cathode filament and the metal layers are cathode electrodes.

6. The fluorescent luminous tube of claim 1, wherein the wire shaped member is a damper of a filament.

7. The fluorescent luminous tube of claim 1, wherein the wire shaped member is a wire grid.

* * * * *